United States Patent [19]

Mickley

[11] 4,038,347

[45] July 26, 1977

[54] HUMIDIFYING APPARATUS

[76] Inventor: Thomas B. Mickley, 1810 172nd NE., Bellevue, Wash. 98008

[21] Appl. No.: 586,275

[22] Filed: June 12, 1975

Related U.S. Application Data

[63] Continuation-in-part of Ser. No. 416,973, Nov. 19, 1973, abandoned.

[51] Int. Cl.[2] ..... B01F 3/04

[52] U.S. Cl. ..... 261/30; 251/5; 261/112; 261/119 R; 261/142; 261/DIG. 15; 261/DIG. 46

[58] Field of Search ..... 261/30, 112, 100, 119 R, 261/142, DIG. 15, DIG. 46; 55/241; 251/5

[56] References Cited

U.S. PATENT DOCUMENTS

| | | | |
|---|---|---|---|
| 1,637,597 | 8/1927 | Ulrici | 55/241 X |
| 2,580,826 | 1/1952 | Osburn et al. | 261/DIG. 46 |
| 2,585,132 | 2/1952 | Kalmadge | 261/142 X |
| 2,753,164 | 7/1956 | Miller | 261/30 X |
| 3,219,796 | 11/1965 | Graf et al. | 261/142 X |
| 3,282,575 | 11/1966 | Allcorn, Jr. | 261/DIG. 15 |
| 3,323,784 | 6/1967 | Fazio | 261/142 X |
| 3,415,276 | 12/1968 | Lind et al. | 251/5 X |
| 3,640,265 | 2/1972 | Swart, Sr. | 261/DIG. 46 |
| 3,643,930 | 2/1972 | Schulze, Sr. | 261/DIG. 46 |
| 3,804,383 | 4/1974 | Van Diepenbroek | 261/30 |
| 3,820,353 | 6/1974 | Shiraishi et al. | 261/100 X |
| 3,854,468 | 12/1974 | Nozaki | 261/DIG. 15 |

FOREIGN PATENT DOCUMENTS

| | | | |
|---|---|---|---|
| 609,207 | 11/1960 | Canada | 55/241 |

*Primary Examiner*—Tim R. Miles
*Assistant Examiner*—Richard L. Chiesa
*Attorney, Agent, or Firm*—Christensen, O'Connor, Garrison & Havelka

[57] ABSTRACT

A humidifying apparatus has an evaporating chamber having an air inlet and an air outlet. The chamber has a bottom wall for supporting a film of water to be evaporated. A drain is associated with the bottom wall for continuously draining water from the evaporating chamber during an operational cycle. A fan is connected to the air inlet of the evaporating chamber to discharge a stream of air into the chamber and across the bottom wall. A water holding tank, having a top wall containing at least one water outlet aperture, is so located in the evaporating chamber to position the aperture adjacent the air inlet and in the flow path of the stream of air. Water supply means selectively supplies water to the holding tank when the fan is operative. The supply means provides a pressure signal, but only when supplying water to the holding tank. A valve means, associated with a water outlet from the holding tank, is in a closed position responsive to the pressure signal. In the absence of the pressure signal the valve means is opened to drain the holding tank.

3 Claims, 5 Drawing Figures

Fig. 1
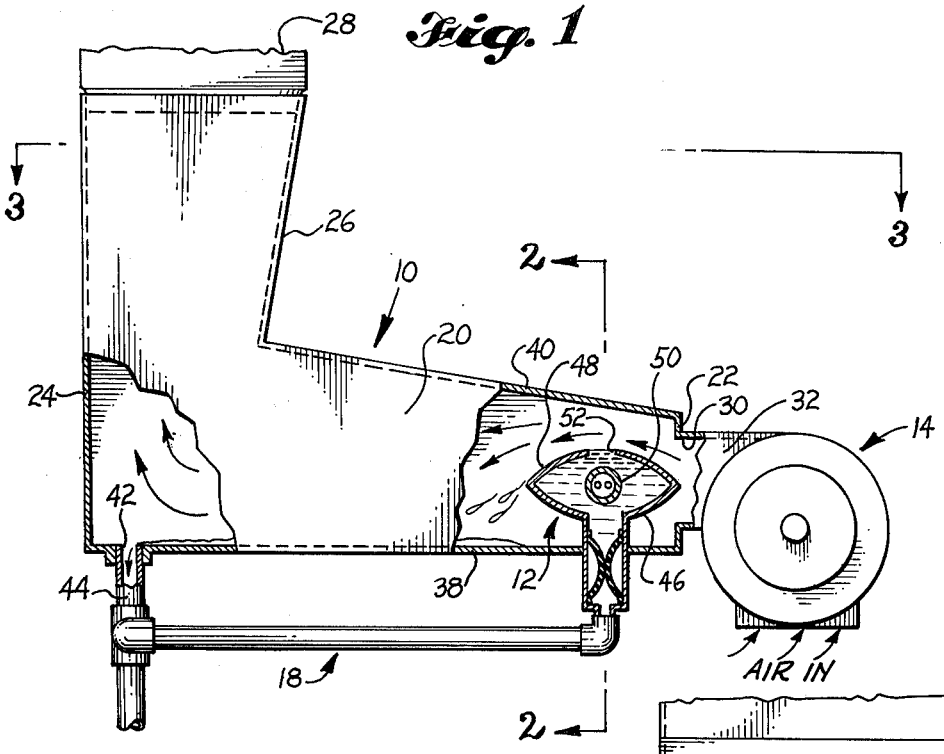
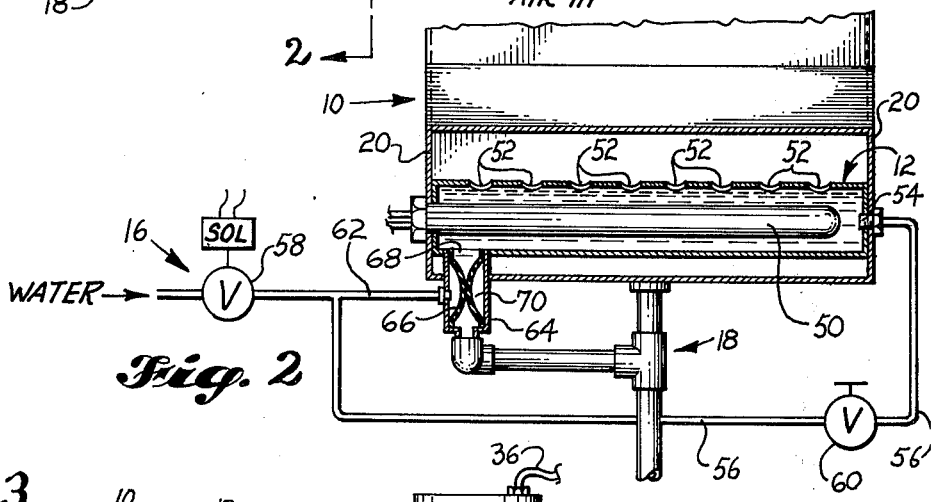
Fig. 2
Fig. 3
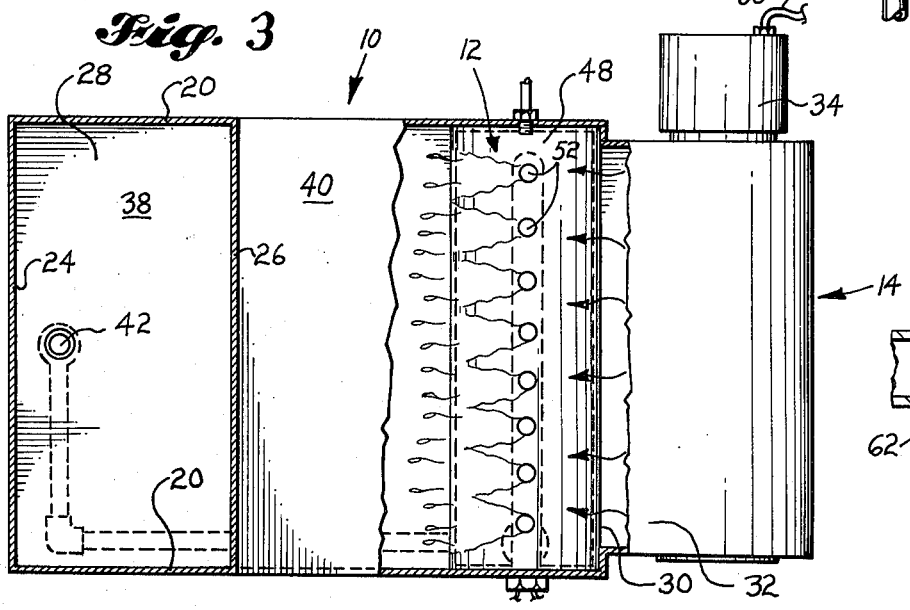
Fig. 4
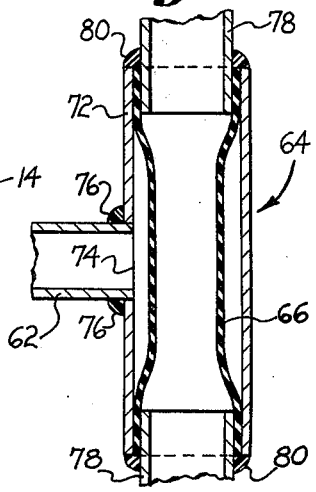

HUMIDIFYING APPARATUS

BACKGROUND OF THE INVENTION

This application is a continuation-in-part of copending application Ser. No. 416,973, filed Nov. 19, 1973, now abandoned.

This invention relates to an air humidifying apparatus and more particulary to a large capacity humidifying apparatus of the forced air type which is supplied with cold water.

One problem with humidifiers of the prior art is the difficulty in constructing small, inexpensive apparatus which has sufficient capacity to meet the demands of commerical and industrial use. Among the problems attendant attempts to increase capacity are a decrease in response time upon demand for humidification, an increase in the amount of precipitated salts and sediment from the water present in the humidifiers, the accumulation of odors in the humidifier caused water stagnation in the water holding tanks, and algae growth in the water holding tanks. The humidification capacity of prior humifidiers has been increased by inserting an electrical heating element in the water holding tank in the humidifiers. The element is used to heat the water and thereby evaporate it, increasing the amount of water vapor available for absorption in an airstream forced through the humidifiers. However, when water is heated, odors not otherwise normally noticed are produced by the water, and in addition, the growth of algae is promoted by the high water temperatures. Means, such as a steam boiler for supplying water vapor, have been devised for combatting the foregoing problems; however, these means utilize complex and rather expensive mechanisms, resulting in an overall higher cost for a humidification device.

It is an object of the present invention to provide a humidifying apparatus which will overcome the foregoing problems and at the same time provide a relatively compact and inexpensive device. It is another object of the present invention to provide a relatively large contact area between the water and an airstream forced through the apparatus while maintaining the volume of water held in the apparatus at a minimum. It is another object of the present invention to drain water from the apparatus at least after each cycle of operation to prevent an accumulation of odor and to diminish algae growth in the apparatus. Another object of the invention is to continuously bleed water from the apparatus during operation to prevent the buildup of sediment and to reduce the amount of precipitated minerals in the humidifier.

Further objects of the present invention are to provide means for supplying water to and a valve arrangement for draining water from a humidifying apparatus during operation, which valve arrangement for draining the apparatus is responsive to discontinuing the supply of water to the apparatus when not in operation; and to provide a humidifying apparatus with a water holding tank of low volume which can be quickly heated to provide rapid response to a demand for humidification.

SUMMARY OF THE INVENTION

The foregoing objects and other objects which will become apparent upon reading the following specification are fulfilled by an air humidifying apparatus comprising a first means defining an evaporating chamber, a second means defining a water holding tank and a third means for selectively supplying water to the holding tank and for creating a pressure signal. During an operational cycle water is continuously supplied to the holding tank causing it to spill over onto the floor of the evaporating chamber, forming a water film on the floor. The water is continuously drained from the floor to carry precipitated and sedimentary material out of the humidifier. A fan provides an airstream to the evaporating chamber which passes over the holding tank and the water film on the chamber floor to evaporate water therefrom. A valve opens to drain the holding tank at the end of each operational cycle. The valve is opened in response to the absence of the pressure signal from the third means.

BRIEF DESCRIPTION OF THE DRAWINGS

A better understanding of the present invention can be derived by reading the ensuing specification in conjunction with the accompanying drawings wherein:

FIG. 1 is a side elevation view in partial longitudinal section of the humidifying apparatus of the present invention;

FIG. 2 is a partial cross-sectional view of the apparatus of FIG. 1 taken along section line 2—2;

FIG. 3 is a longitudinal sectional view taken along section line 3—3 of FIG. 1 with parts of the apparatus broken away;

FIG. 4 is a longitudinal sectional view of a preferred drain valve for use with the present invention.

DESCRIPTION OF PREFERRED EMBODIMENT

Figure 5:
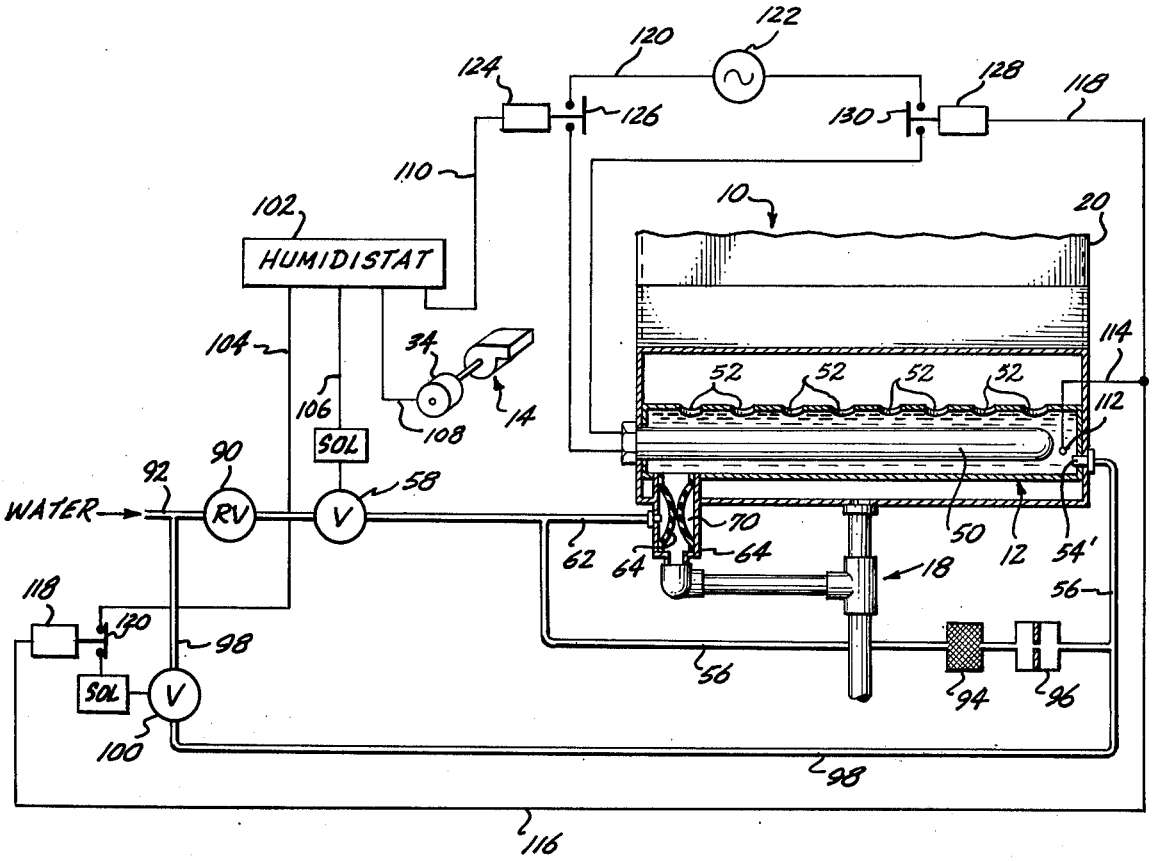
FIG. 5 is a cross-sectional view similar to FIG. 2 illustrating an alternate embodiment of the invention.

Referring to the FIGS, the humidifying apparatus includes an evaporating chamber 10, a water holding tank 12, a fan 14, a water supply system, generally designated 16, and a drain plumbing system, generally designated 18.

The evaporating chamber is formed within two upright laterally spaced side walls 20, a first end wall 22 longitudinally spaced from a second end wall 24, a floor 38, and a top wall 40 spaced above the floor. A third upright wall 26 is spaced from an upward extension of end wall 24. The third wall and the upward extension of the second end wall are joined together by upward extensions of the side wall 20 to form air outlet 28 in the evaporating chamber. The first end wall 22 has a rectangular inlet 30 formed therein to which is attached a duct 32 leading from the exhaust outlet of the fan 14. The fan 14 can be a tangential blower or any other conventional type suitable for the intended purpose. The fan 14 is driven by an electric motor 34 in turn connected to a power relay (not shown) via electrical leads 36. The bottom wall 38 of the chamber 20 is oriented in a horizontal position, or if desired, can be slanted downwardly from the air inlet side toward the air outlet side, the purpose of which will be better understood from the description below.

A drain opening 42 is located in the bottom wall 38 adjacent the second end wall 24. A conduit 44 is secured in the bottom wall at the drain opening 42 to provide a channel for draining water from the evaporating chamber 10. However, if desired, a restricting orifice (not shown) can be placed in the conduit 44 and a second overflow drain conduit (not shown) can be connected to a separate drain outlet (not shown) in the end wall 24 or the side walls 20 a spaced distance above the bottom wall 38. In this manner, the flow of water from the bottom floor can be controlled. However, should the orifice clog or otherwise fail, the overflow drain is provided to prevent the entire unit from flooding.

The water holding tank 12 is positioned near the air inlet 30. The holding tank has a lower wall 46 which from the center portion thereof is of upwardly arcuate configuration in both the direction of flow of the airstream from the inlet 30 and against the direction of flow of the airstream. The tank also has an upper wall 48 which from the center portion thereof is of downwardly arcuate configuration toward and away from the direction of flow of the airstream. The upper and lower walls are joined together at the sides to form the top and bottom of the water holding tank. The upper and lower walls 48 and 46 extend laterally across the entire width of the evaporating chamber and are secured at their ends to end walls, which are in turn secured to the side walls 20 of the evaporating chamber. In the preferred embodiment the holding tank is so located relative to the air inlet to split the flow of air entering the air inlet 30.

A heating element 50 is positioned in the central portion of the holding tank to heat the water in the tank. The heating element 50 can be of the electrical resistance type or any other suitable heating means. The heat output of the heating element is chosen sufficiently large in comparison to the volume of water which can be held by the holding tank to heat the water to boiling in a relatively small amount of time, on the order of a few minutes. In this way water begins to evaporate quickly from the holding tank to provide a quick response to a demand for humidification.

The top wall 48 of the heating tank 12 contains a plurality of apertures 52 which are spaced along the longitudinal extent of upper wall 48 at the highest location thereon. Water supplied to the holding tank 12 overflows these apertures across the forward portion of the upper wall 48 and then drops onto the bottom wall 38 of the evaporating chamber. Excess water from the floor flows out of the drain opening 42, carrying precipitated and sedimentary material with it.

Water is supplied to the holding tank through the water inlet 54 which is in turn connected to the conduit 56. Conduit 56 is connected to a solenoid actuated valve 58 in turn connected to a water supply. The valve 58 opens and closes the conduit 56 to flow. Conduit 56 also contains a conventional spring and diaphragm pressure reducing valve 60. It may be set manually to regulate, if desired, the flow rate of water through conduit 56 into the holding tank 12. The optimum flow rate is achieved when water flows out of the drain opening 42 at a temperature below 90° F.

A water pressure tap 62 is connected to conduit 56 and is placed in communication with water pressure responsive drain valve 64. The inlet to the valve 64 in connected to a drain opening 68 in the bottom of holding tank 12. The outlet to the valve 64 is connected to the drain plumbing 18 through which water from the holding tank and the evaporating chamber is disposed of. The valve 64 is of a conventional fluid pressure operated type comprising a flexible, resilient membrane 66 of circular cross-section. The circular ends of the flexible membrane are affixed to the circular inlet and outlet ends of the body of the valve 64. An annular chamber 70 is formed between the exterior wall of the flexible membrane 66 and the interior wall of the body of the valve 64. The outlet of the conduit 62 is in fluid communication with the annular chamber 70. When the solenoid valve 58 is opened, water pressure is supplied through conduit 62 to the annular chamber 70 causing the flexible membrane 66 to compress upon itself and close the valve to flow. Likewise, when the valve 58 is closed and water pressure is relieved in conduit 62, the water drains from the holding tank 12 and enters the drain plumbing 18.

The fan motor 34, and the solenoid operated valve 58 are connected to a power relay (not shown). This power relay is opened and closed upon a signal from a conventional humidistat (not shown) which can be adjusted to provide a signal dependent upon the desired humidity level of the environment surrounding the humidistat. When the humidistat signals a demand for humidity, the power relay is tripped to energize the fan motor and the solenoid valve. When the supply valve is opened by the solenoid, the holding tank beings to fill, through the inlet 54. Sediment remaining in the tank 12 from the previous cycle of operation is washed across the floor 38 by the incoming water toward outlet 68 from which it is drained during a subsequent cycle. At the same time, the valve 64 is closed because water pressure is supplied to the annular chamber 70 in the valve 64, causing the membrane 66 to compress upon itself. The modulating valve 60 is set to supply water to the holding tank 12 at a rate which is about 50 to 100 percent greater than the evaporation rate from the holding tank. In this manner water will overflow from the holding tank through the apertures 52 across the top forward portion of the upper wall 48 onto the bottom wall 38. As the holding tank 12 is filled, the heating element 50 heats the contents of the holding tank to boiling temperatures causing water to evaporate through the apertures 52. Because the heating element is sized to heat the water in the holding tank at a high rate and because the holding tank itself is relatively small, a very quick response time, on the order of less than a minute, can be provided by the present invention.

When the fan motor is energized, the fan exhausts into the inlet 30 to form an airstream which travels under and across the top of the holding tank 12. As it does so additional water flows from the holding tank 12 and is forced forwardly above the upper surface of the rearward portion of the wall 48 into the airstream. The fan airstream then moves in the direction of the arrows through the chamber and exhausts upwardly through the outlet 28 from the chamber 10. The water that overflows from the holding tank 12 is entrained in the airstream where further evaporation occurs. Excess water not evaporated within the chamber falls to the bottom wall 38 and travels to the drain opening 42 and into the drain plumbing 18. This continuous draining of the water from the bottom wall 38 of the evaporating tank will maintain water movement across the bottom wall 38 to prevent a buildup of sediment and precipitated minerals. The heat transferred to the airstream from the outside walls of the holding tank increases the temperature of that air, thereby allowing the air to evaporate more water. Thus, all heat input to the humidifier is used for water vaporization without the requirement for thermal insulation. Since the water is hot and is entrained in the warm airstream, a relatively high air flow can be maintained while still saturating the air traveling through the chamber. In this manner a highly efficient humidifying apparatus is provided.

When the humidistat signals that the demand for humidification has been fulfilled, the power relays to the fan, heating element, and supply valves are opened, deenergizing the heating element and the fan motor and closing the solenoid valve. When the water pressure in the conduit 56 is relieved, the pressure in the annular chamber 70 is also relieved allowing the flexible membrane 66 to relax, causing the valve to open. The water then drains from the holding tank 12 into the drain plumbing 18. Because the operation of the valve 64 is responsive to the decrease in water pressure in the conduit 56, the holding tank 12 drains automatically, eliminating the necessity for expensive electronic mechanisms or additional solenoid valves. Because the valve 64 is of the flexible membrane type, it has a straight through flow path when open. This ensures rapid drainage with maximum sediment entrainment. Precipitated solids will not be entrapped as they could in a conventional valve. Should any solids remain inside membrane 66 after drainage of tank 12, they will not prevent water-tight closure of valve 64 at the start of the next cycle of humidification. By draining the holding tank after each cycle of operation the precipitated minerals in the holding tank will not accumulate, reducing the frequency of cleaning. In addition, the odor potential is reduced because no water remains in the apparatus when it is not operating. There is no possibility for undersirable algae growth which could ultimately clog the apertures or produce unpleasant odors.

Referring now to FIG. 4, the preferred embodiment of the drain valve 64, a length of cylindrical tubing, for example extruded aluminum or copper tubing comprises the body 72 of the valve. The body of valve contains an opening 74 in its periphery centered between the two ends of the body. The water pressure tap pipe 62 is fitted in the opening 74, preferably in an interference fit. A bead 76 of epoxy bonding material seats and secures the pipe 62 in the opening 74. A central flexible and resilient sleeve-like membrane 66 is positioned inside the body 72 of the valve. The membrane has a circular cross-section, an outside diameter less than the inside diameter of the body 72, and a length approximately equal to the length of the body 72. The membrane 66 can be produced from natural or synthetic plymeric surgical tubing of appropriate size.

The membrane 66 is secured in the body of the valve at each end of tubular end fittings or connecting members 78, the exterior ends of which are broken away. The end fittings can also be formed from copper and aluminum tubing as is the body. Alternatively polyvinyl chloride or other synthetic tubing material can be used for the fittings and body of the valve. The exterior ends can be threaded to join conventional fittings or can be otherwise conventionally configured. The outside diameter of the interior ends of the end fittings is slightly greater than the inside diameter of the body 72 minus twice the thickness of the membrane 66 in a relaxed state. Thus, when the end fittings are inserted in the ends of the body, with the end of the flexible member imposed between the interior wall of the body and the exterior wall of the end fitting, a fluid tight seal is formed. The membrane is stretched over the ends of the end fittings so that the central portion of the wall of the membrane is spaced from the interior wall of the body 72 to define the annular pressure chamber between the body 72 and the membrane 66. An epoxy cement, or other suitable bonding material, is placed in the form of beads 80 around the end fittings so that is contacts the ends of the membrane and the ends of the valve body. The epoxy beads secure the membrane and the end fittings to the body 72. The valve 64 can then be incorporated into the drain plumbing as shown in FIGS. 1 and 2.

This valve construction provides a small valve structure which can be incorporated into small diameter plumbing, a feature not available in similar valves of the prior art. It can be easily modified for use with threaded plumbing fittings or with bonded bell type fittings normally encountered with small diameter plumbing of copper pipe or synthetic tubing. The construction of the valve does not require specially manufactured parts, but uses conventional tubing and piping cut to the appropriate size. The valve is very economical to manufacture because of low material cost and simplicity in assembly. Its one piece bonded construction requires little handling and easy incorporation into a plumbing system. It has no external moving parts, therefore reducing damage susceptibility to a minimum and requiring no maintenance over extended use.

Referring now to the alternate embodiment of the humidifying apparatus of the present invention as shown in FIG. 5, the evaporating chamber 10 and water holding tank 12, heating element 50, fan 14, and pressure responsive drain valve 64 are all constructed and arranged in a manner substantially identical to the preferred embodiment described above. The alterations in this embodiment relate primarily to the water supply system and means for controlling the water supply system and energization of the heating element 50.

Water is supplied to the water supply system via an inlet conduit 92 having a pressure reducing valve 90 and the normally closed solenoid actuated valve 58 interposed therein. The outlet of valve 58 is coupled via line 56 to the water inlet connection 54' to the holding tank 50. The inlet connection 54' is located adjacent the bottom of the tank 50. A filter element 94 is interposed in line 56 and a flow reducing orifice 96 is interposed in supply line 56 downstream from the filter element 94. A second high flow rate water supply line is coupled to the inlet conduit 92 and to the supply line 56 downstream of the orifice 96. A second, normally closed solenoid operated valve 100 is interposed in line 98 to control the flow therethrough.

A humidistat 102, located in a room or other enclosure to be humidified controls the energization of both the solenoid operated valves 58 and 100. When the humidistat calls for humidification, an appropriate control signal is sent along electrical control leads 104 and 106, energizing the solenoids is both valves 58 and 100 to open them, allowing water to flow from the inlet conduit to the inlet connection 54' to the holding tank 50 via lines 56 and 98. At the same time the humidistat energizes the fan motor 34 via a signal sent along lead 108.

The heating element 50 is energized from an alternating current source via leads 120. Two normally open relays 124 and 128 are interposed in series in the circuit 120. Upon a demand for humidification the humidistat 102 energizes the coil of relay 124 via line 110, causing the normally open contacts 126 of the relay to be closed.

A water level sensor 112 is positioned in the water holding tank at a location slightly below or above the bottom of the heating element 50. When the water level in the tank rises to the level of the sensor 112 upon a demand for humidification, a control signal is forwarded along control lead 114, which is in turn coupled to a control lead coupled to the coil of the normally open relay 128. The control signal from lead 118 energizes the coil of relay 128 to close the normally open contacts 130 of relay 128 to complete the circuit 120 and energize the heating element 50. The control signal from the level sensor 112 is also sent along lead 116 to the coil of a normally closed relay 118. The contacts 120 of the relay 118 are in series connection with the control lead 104 between the humidistat and the solenoid valve 100. When the control signal from lead 116 reaches the relay 118, the normally closed contacts 120 of the relay are opened, breaking the control circuit from the humidistat to the solenoid valve 100, thus deenergizing the solenoid valve and allowing it to return to its normally closed position.

The sequence of operation of the embodiment of the humidifying apparatus just described, begins with a call for humidification by the humidistat 102. This causes control signals to be forwarded along lines 104, 106, 108 and 110 respectively to open solenoid valve 100, to open solenoid valve 58, to energize fan motor 34 and to close the contacts 126 of relay 124. When solenoid valve 58 is opened the water pressure in line 62 causes the drain valve 64 to close. Water also flows through line 56 to the tank 50 at a rate slightly higher than the evaporation rate from the tank when the apparatus is in full operation. Water is also supplied via supply line 98 to the tank 50 at a relatively high rate to partially fill the tank 50. Allowing the tank to partially fill at a relatively high rate substantially reduces the response time of the humidifying apparatus.

When the water level reaches the level sensor 112, the control signal received by the relay 118 opens the contacts 120 to deenergize and close the valve 100. Thus the tank continues to fill at a relatively low rate as supplied through valve 58 and line 56. The level sensor also sends a control signal to relay 128 to close contacts 130 to energize the heating element 50. At this time the water level has almost reached the bottom of the element 50. However, since water is being supplied at a relatively low rate, the element is allowed to become red hot before it is submersed by the water in the tank. This heats any scale or deposit on the element to a high temperature. As the water level rises, the element is submerged and is quenched. As this occurs, the scale and deposits on the element will tend to flake or peel away. At the end of a humidification cycle this scale will be washed out of the tank through a valve 64, resulting in a clean element and holding tank 50.

When the demand for humidification has been fulfilled, the humidistat will provide a control signal to close the valve 58, thus reducing the water pressure in line 62, allowing the drain valve 64 to open. At the same time the relay 124 is returned to its normally open position and the fan motor is deenergized. A control signal is also forwarded to the valve 100 to close it, although the control circuit to the valve 100 has already been broken by opening the contacts 120, thus closing the valve 100. As the water drains from the tank 50 and falls below the level sensor 112, the contacts of relays 118 and 128 are returned to their respectively normally closed and normally open positions. In this manner the humidifying apparatus and accompanying control system is reset and available for the next demand for humidification from the humidistat.

The present invention has been described in relation to a preferred embodiment; however, it is to be understood that one of ordinary skill in the art could effect various changes to and substitutions of equivalents in the apparatus as described and illustrated without altering the original concept of the invention. It is therefore intended that the invention be limited only by the definition contained in the appended claims.

What is claimed is:

1. An air humidifying apparatus comprising:

first means defining a humidification chamber having an air inlet, and air outlet, a water outlet, a bottom wall, a first end wall and an opposite end wall, said end walls attached to and extending upwardly in spaced relationship from said bottom wall, a pair of side walls attached to and extending upwardly in spaced relationship from said bottom wall and being affixed to said end walls, and a top wall spaced from said bottom wall and attached to said side walls and said end walls, said walls defining said chamber, said air outlet and said water outlet being located adjacent to opposite end wall of said chamber, said air inlet being located in said first end wall, said water outlet being associated with said bottom wall, said bottom wall being so constructed and oriented to support and direct water present thereon toward said water outlet, fan means operatively associated with said first end wall and connected to said air inlet for discharging a stream of air into said chamber, said air inlet and said chamber being so constructed as to cause said stream of air to pass across said bottom wall and exhaust through said air outlet, second means associated with said first means and defining a holding tank for water, said second means including a top wall having at least one aperture therein, said aperture being positioned in said chamber adjacent said air inlet, said second means having a water inlet and a water outlet, said second means being positioned and oriented within said chamber and being spaced from said bottom wall of said first means so that the stream of air discharged by said fan means is split by said holding tank, thereby causing a portion of the stream of air to pass over said holding tank and causing a portion of the stream of air to pass under said holding tank, said portions of said airstream being recombined at a location downstream from said holding tank, third means for selectively supplying water to the water inlet of said second means when said fan means is operative, said third means providing a control signal only when supplying water to said second means, heater means for heating the water in said second means to evaporate water therefrom, and valve means associated with the water outlet of said second means, said valve means closing said water outlet responsive to said control signal provided by said third means and opening said water outlet in the absence of said signal provided by said third means to rapidly drain water from said holding tank and thereby entrain and remove sediment present in said holding tank after each humidification cycle.

2. The apparatus of claim 1 further comprising:

level sensing means in said holding tank for providing a second control signal when the water level in said holding tank rises to a predetermined level adjacent said heater means, said heater means being energized responsive to said second control signal.

3. The apparatus of claim 2 further comprising:

fourth means associated with the water inlet to said second means for selectively supplying water thereto, said third means supplying water to said second means at a first predetermined rate, said fourth means supplying water to said second means at a second rate higher than said first rate, said fourth means being responsive to said second control signal to stop supplying water to said second means.

* * * * *